US006948625B2

(12) United States Patent
Keberlein

(10) Patent No.: US 6,948,625 B2
(45) Date of Patent: Sep. 27, 2005

(54) SHEET DISPENSER AND CARTON FOR MAKING A SHEET DISPENSER

(75) Inventor: Gerald James Keberlein, Hortonville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/025,384

(22) Filed: Dec. 19, 2001

(65) Prior Publication Data

US 2003/0111432 A1 Jun. 19, 2003

(51) Int. Cl.[7] ..... B24F 1/00
(52) U.S. Cl. ..... 211/50; 211/55; 211/73
(58) Field of Search ..... 211/50, 55, 73, 211/72, 85.4, 38, 10, 85; 229/104; 206/494, 485

(56) References Cited

U.S. PATENT DOCUMENTS

| | | | | | |
|---|---|---|---|---|---|
| 1,908,841 | A | * | 5/1933 | Hawks | 229/104 |
| 1,986,546 | A | | 1/1935 | Wendling | |
| 2,142,826 | A | * | 1/1939 | Rosello | 248/174 |
| 2,222,211 | A | * | 11/1940 | Arneson | 211/50 X |
| 2,280,793 | A | * | 4/1942 | Carruth | 211/55 X |
| 2,331,038 | A | * | 10/1943 | Meller | 211/73 |
| 2,474,763 | A | | 6/1949 | Thomas | |
| 2,488,262 | A | | 11/1949 | Bengelsdorf | |
| D167,809 | S | | 9/1952 | Roop | |
| 2,631,042 | A | * | 3/1953 | Gertram | 273/148 A |
| 2,854,134 | A | * | 9/1958 | Humphrey | 224/42.32 |
| 2,872,093 | A | * | 3/1959 | Chaplin | 211/50 X |
| D191,592 | S | | 10/1961 | Wolf et al. | |
| 3,064,799 | A | * | 11/1962 | Butler | 211/73 X |
| 3,125,258 | A | * | 3/1964 | Watts | 211/55 X |
| 3,216,582 | A | | 11/1965 | Cross | |
| 3,291,365 | A | * | 12/1966 | Koene | 211/50 X |
| 3,294,229 | A | | 12/1966 | McConnell et al. | |
| 3,462,020 | A | * | 8/1969 | Hall | 211/26.2 |
| 3,499,575 | A | * | 3/1970 | Rockefeller | 221/55 |
| 3,610,514 | A | * | 10/1971 | Samsing | 229/108 |
| 3,950,918 | A | * | 4/1976 | Morrow et al. | 53/410 |
| 4,230,258 | A | * | 10/1980 | Lane | 206/585 |
| 4,275,811 | A | * | 6/1981 | Miller | 206/204 |
| D276,206 | S | | 11/1984 | Williams | |
| 4,796,801 | A | * | 1/1989 | Goetz | 229/104 |
| 4,874,099 | A | | 10/1989 | Arnott et al. | |
| 4,877,154 | A | * | 10/1989 | Matsui | 221/48 |
| 5,007,530 | A | * | 4/1991 | Weismantel | 206/45.21 |
| 5,145,091 | A | * | 9/1992 | Meyers | 221/45 |
| D332,726 | S | | 1/1993 | Goodman | |
| 5,201,428 | A | | 4/1993 | Pasinski et al. | |
| 5,259,550 | A | * | 11/1993 | Kuchenbecker | 229/109 |
| 5,295,590 | A | | 3/1994 | Feer | |
| D346,721 | S | | 5/1994 | Feer | |
| 5,405,019 | A | | 4/1995 | Cross | |
| 5,613,608 | A | * | 3/1997 | Tronchetti et al. | 206/494 |
| 5,884,767 | A | * | 3/1999 | Peng | 206/485 |
| 5,901,843 | A | * | 5/1999 | Gambardella et al. | 206/308.1 |
| 5,908,153 | A | * | 6/1999 | Greer et al. | 229/122.2 |
| 5,915,546 | A | * | 6/1999 | Harrelson | 206/200 |
| 5,971,168 | A | * | 10/1999 | Proulx | 211/85.4 |
| 6,079,563 | A | * | 6/2000 | Katchmazenski | 206/583 |
| 6,393,749 | B1 | * | 5/2002 | Haupt | 40/725 |
| 6,533,164 | B1 | * | 3/2003 | Correll | 229/150 |

FOREIGN PATENT DOCUMENTS

| | | |
|---|---|---|
| WO | 0046107 | 8/2000 |

* cited by examiner

*Primary Examiner*—Bruce A. Lev
(74) *Attorney, Agent, or Firm*—Dority & Manning, P.A.

(57) ABSTRACT

A sheet dispenser and a method of making a sheet dispenser is disclosed. A carton may be adapted for storing and displaying stacked sheet materials, such as napkins, paper towels, facial tissues, and other absorbent products that may be used in home or a commercial setting. A carton or napkin holder may comprise a one-piece blank which is adapted to be folded, resulting in a carton having a bottom panel, a first sidewall, and a second sidewall. The sidewalls may be secured in place by fixing them to the bottom panel.

31 Claims, 8 Drawing Sheets

SHEET DISPENSER AND CARTON FOR MAKING A SHEET DISPENSER

BACKGROUND OF THE INVENTION

A variety of U-shaped holders for sheet materials have been employed. Such holders have been used to secure envelopes, note paper, paper napkins, memorandum pads, calendars, and the like. Such holders generally have been constructed of relatively stiff, cast metal or molded plastic type materials, and often have been shaped into their ultimate form at the point of fabrication. Typically, these holders are permanent fixtures, which are purchased separately from the items that they are designed to hold.

U.S. Pat. No. 5,405,019 to Cross is directed to a display mounting apparatus adapted to support books and loose materials. The device disclosed in this patent provides sturdy metal hinges to provide a strong support. The device provides panels that may is be oriented diagonally, for supporting a vertical panel. U.S. Pat. No. 3,216,582 to Cross shows a U-shaped holder for securing sheets of material with a pair of upright panels that rotate on a base element. The upright panels may be folded on a hinged area and collapsed for packing or shipping.

Typical dinner napkins, for example, may be sold in lightweight cellophane packages. A consumer may purchase a napkin holder of any variety, and also a package of napkins. Then, at another location (which could be the home) he or she inserts the napkins into the holder for display and use. Thus, the same permanent napkin holder may be used in the home, or in a restaurant, for many years. Thus, such a holder may be refilled numerous times with new napkins.

Refilling sheet material dispensers, such as napkin holders, is a time consuming procedure. In a restaurant setting, the time required to load new napkins or sheet materials into a holder may be fairly extensive, increasing labor costs. At home, it is an additional extra step to refill and/or reload permanent holders. Furthermore, many consumers become weary of the ordinary appearance of such holders. It would therefore be desirable if there was a convenient means to decorate such holders for seasonal or holiday events.

Many consumers avoid using permanent, fixed sheet holders in the home because of the excessive cost of such holders. Furthermore, many sheet holders are designed for repeated use, and are not easily adapted as inexpensive, lightweight, and/or disposable. Thus, in the case of napkins, such permanent holders are not typically used for outdoor events, picnics, and the like. This is true in part because of the difficulty required to transport the holder and napkins to the event, and the necessity to bring the holder home (i.e. return it) after the event. Thus, there are significant limitations to currently known holders of this type.

What is needed is a relatively inexpensive, lightweight, easy to manufacture and attractive holder for sheet products. A holder that is capable of convenient and inexpensive manufacture would be desirable. A holder that is packaged and capable of being sold pre-filled with sheet material, and provided as a single pre-loaded unit, also would be highly desirable. Furthermore, in the case of napkins and folded paper products, a lightweight and/or disposable dispenser capable of reliably holding and dispensing folded napkins for display and use is needed.

SUMMARY OF THE INVENTION

In the invention, a carton may be adapted for storing and displaying stacked sheet material. In some applications, the carton may comprise a one-piece blank adapted to be folded in a manner that results in a carton having a bottom panel, a first sidewall, and a second sidewall. The bottom panel includes a first edge and a second edge. The first sidewall is erected along the first edge, and the second sidewall is erected along the second edge of the bottom panel. Furthermore, a first flap extending from the first sidewall over at least a portion of the bottom panel is adapted to be secured to the bottom panel. In other applications of the invention, a second flap may be used as well.

In one embodiment of the invention, the carton having a first and a second flap may include space that exists between the flaps and the bottom panel when the carton is in a folded position. Sometimes adhesive is used to fill the space, securing the first and second sidewalls in an erect position. In some applications, other means may be used to secure the flaps to the bottom panel for erecting sidewalls.

In some applications of the invention, the carton is capable of assuming both a relaxed position, in which space is provided between the first flap and the bottom panel, and a bonded position in which the first flap is secured to the bottom panel.

In one embodiment of the invention, the carton may assume a tensioned position in which sheet material or napkins may be positioned between the first and second sidewalls and held in place, in part, by pressure applied from the first or second sidewall. That is, a second stage gluing application may provide the sidewalls in a slightly canted position in which they lean slightly towards each other and are capable of squeezing sheet material therebetween.

In at least one application of the invention, gusset tabs may be employed in connection with adhesive to secure the bottom flaps to a bottom panel, providing sidewalls which are slightly canted.

BRIEF DESCRIPTION OF THE DRAWINGS

A full and enabling disclosure of this invention, including the best mode shown to one of ordinary skill in the art, is set forth in this specification. The following Figures illustrate the invention:

FIG. 2 reveals a top view of a carton blank that is cut and ready for folding to form a sheet dispenser as shown in FIG. 1;

FIG. 3 depicts a partially folded carton blank;

FIG. 4 shows a next step in folding and constructing the sheet dispenser, in which panels are folded into position and adhesive is applied;

FIG. 5 shows the side panels after they have been affixed to each other, with bottom panels ready to receive an adhesion means;

FIG. 6 is a view of a next step in the folding and construction of the sheet dispenser in which one side panel pair has been raised vertically, and one bottom panel has been adhesively secured in place;

FIG. 7 shows a fully formed sheet dispenser ready to receive sheets to form a final product as shown previously in FIG. 1.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description.

The invention of this application, in one embodiment, is directed to a carton adapted for storing and displaying stacked sheet materials. The stacked sheet materials comprise napkins, wipers, folded towels, and other absorbent products. The invention may include a carton adapted for holding, storing and managing the transportation of essentially any type of sheet material or web that may be folded, or not folded.

In other applications, a disposable holder may be provided for disposable paper products such as napkins, paper towels and the like. Some applications of the invention may utilize decorative graphics to be employed, for example, when the carton is to be used as a pre-packed tabletop or counter top decorative dispenser. The invention has application for home use and commercial use as well.

Figure 1:
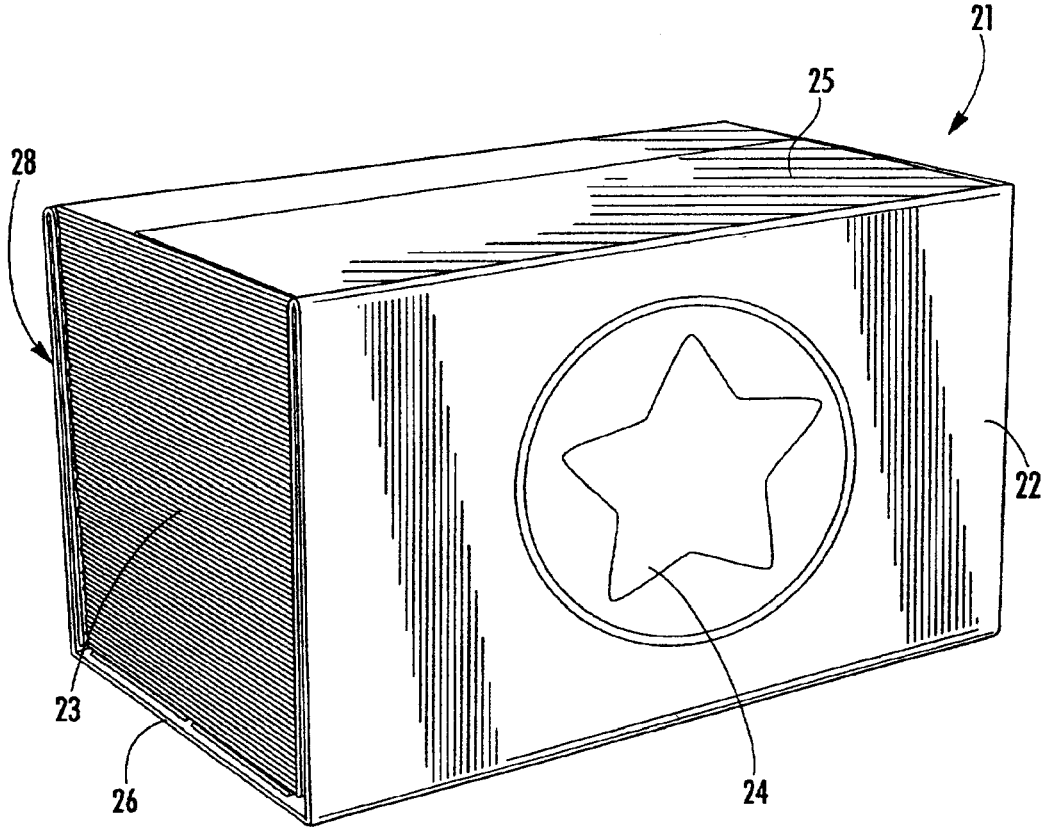
FIG. 1 is a perspective view of a sheet dispenser of the invention.

Turning to FIG. 1, a sheet dispenser 21 is illustrated having a first outer sidewall 22 and a second outer sidewall 28. The second outer sidewall 28 is located behind the horizontally stacked sheets 23 in FIG. 1. In this particular example, the stacked sheets comprise dinner napkins, but the application of the invention is not limited to dinner napkins, and may be applied broadly as described above. Furthermore, a bottom panel 26 is connected to the first outer sidewall 22 and the second outer sidewall 28. A decorative motif 24 is shown on the first outer sidewall 22. However, the decorative motif 24 is entirely optional, and there is no limit to the number of different graphic representations that can be used in the application of the invention. The particular decorative motif 24 is merely a representation of one example that can be employed. A cellophane or other clear plastic outer wrap 25 may be employed. The outer wrap 25 typically is removed prior to using the product for display on a table or countertop.

Figure 2:
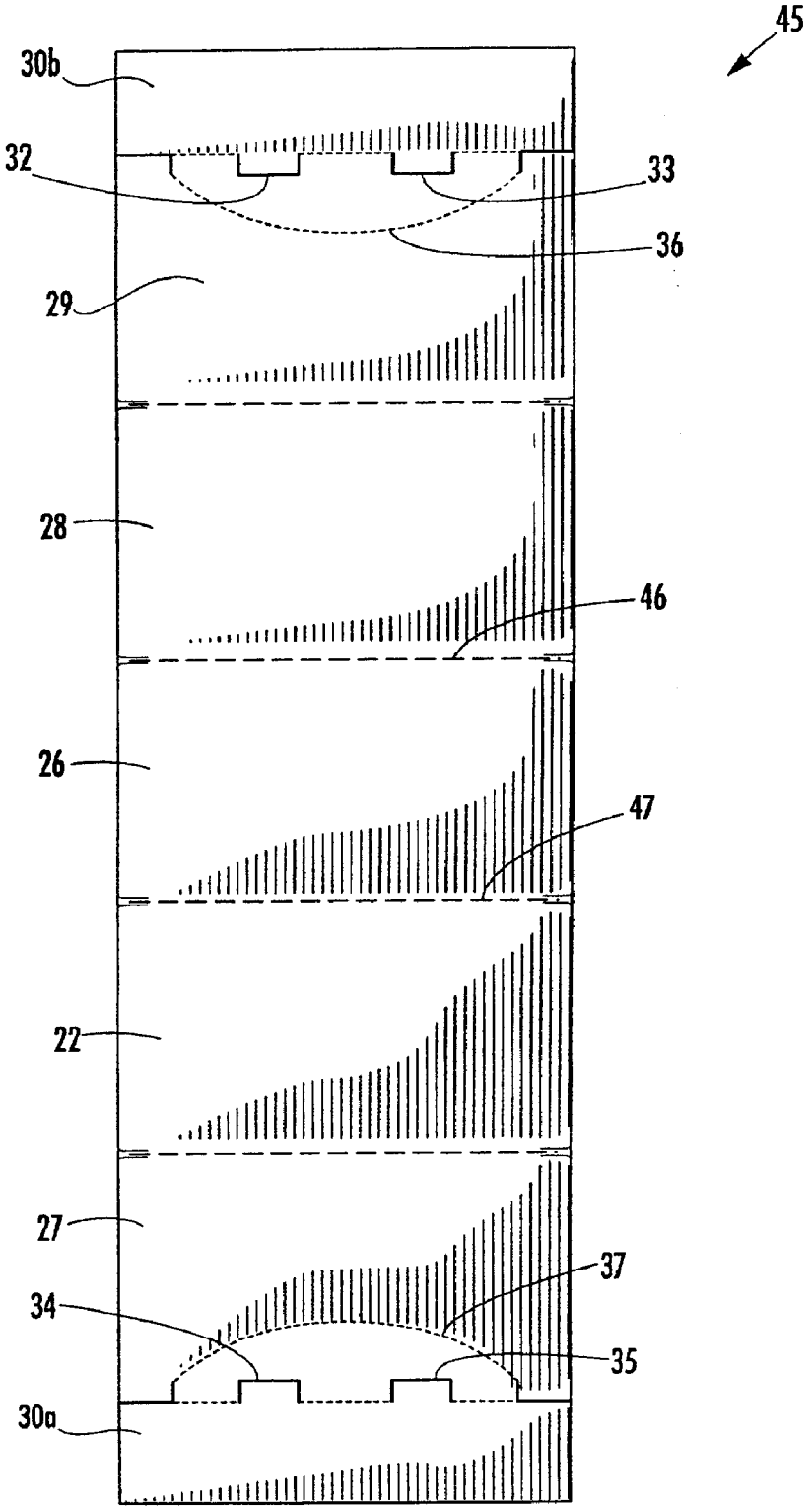
FIGS. 2–7 show a progression of steps in folding and forming a finished sheet dispenser from a carton blank.

FIG. 2 shows a perspective view of a one-piece blank 45 that may be employed in some applications of the invention. The one-piece blank 45 may be formed of paper or any ridged material, and may be laminated or unlaminated. In some applications, the one-piece blank 45 may be printed, while in other applications it may be unprinted. In general, the one-piece blank 45 may be formed into a finished sheet dispenser 21 by a series of steps that are described herein. In some applications of the invention, a gluing step is performed. In other applications of the invention, both a first stage and a second stage gluing step may be performed, as further described below.

In FIG. 2, a bottom panel 26 is shown near the center of FIG. 2, and first outer sidewall 22 and second outer sidewall 28 are shown on either side of the bottom panel 26, and are connected thereto. Furthermore, a second inner sidewall 29 and a first inner sidewall 27 are shown as well. The first arch 36 circumscribes first gusset tab 32 and second gusset tab 33. Near each end of the one-piece blank 45 is first arch 36 and second arch 37, respectively. The first arch 36 and second arch 37 form a dividing line between the portion of the sidewalls which are adhesively secured to each other and the portion of said walls which is not adhesively secured. Thus, the first and second arches 36–37 assist in providing a tensioning force, as further described herein. In the particular example shown in FIG. 2, the arch 37 circumscribes third gusset tab 34 and fourth gusset tab 35.

The first, second, third, and fourth gusset tabs 32–35 assist in erecting and maintaining the rigidity of the first outer sidewall 22 and second outer sidewall 28, as further described below. The particular example shown in FIG. 2 includes a total of two gusset tabs at each end of the one-piece blank 45, however, there is no limit to the number of gusset tabs that could be employed. In fact, it would be possible to construct the invention without gusset tabs at all, but it has been found that the use of gusset tabs may be advantageous.

A first flap 30*a* is shown near the bottom of FIG. 2, and a second flap 30*b* is shown near the top of FIG. 2. When the one-piece blank 45 is folded into a sheet dispenser 21, the second flaps 30*a–b* may be secured to the bottom panel 26 as further described below.

The first edge 46 is shown along one side of the bottom panel 26, and a second edge 47 is shown along the opposite side of the bottom panel 26. The walls of the dispenser 21 are erected proximate to the first edge 46 and the second edge 47, respectively, as further shown in the Figures.

Figure 3:
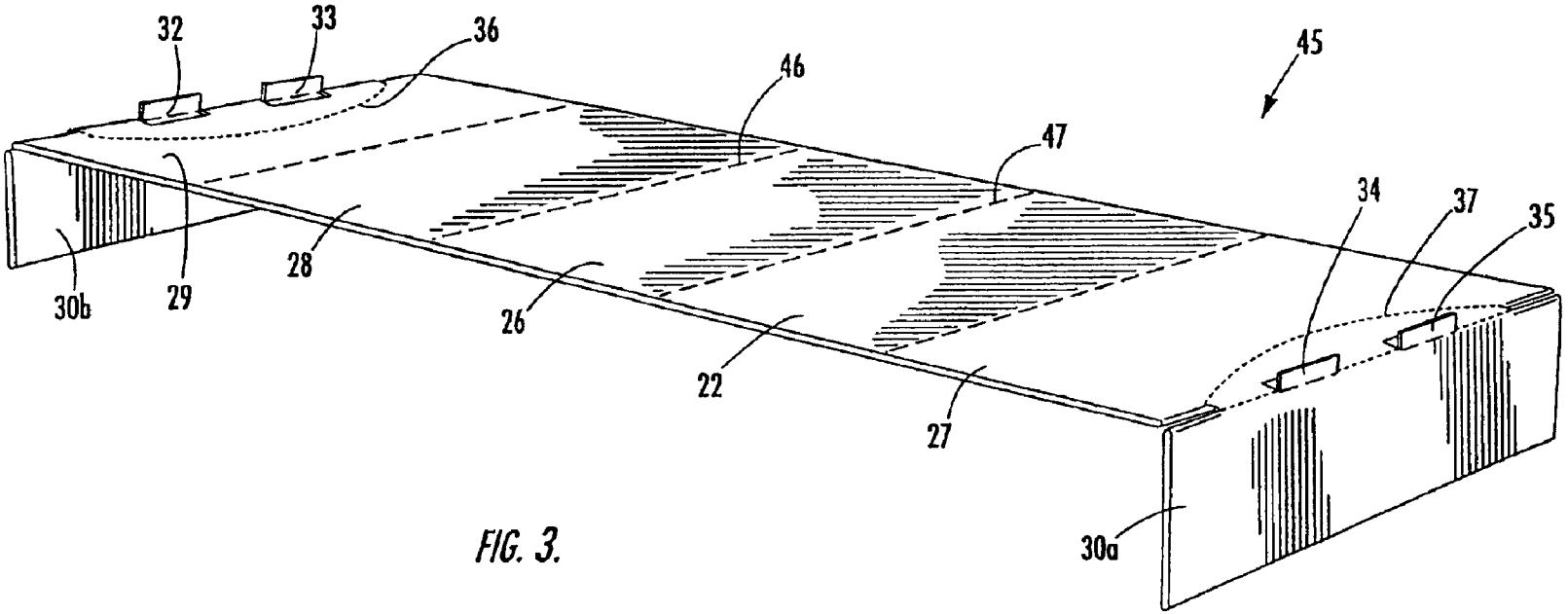

In the folding of the one-piece blank 45, FIG. 3 shows a first step in which the first flap 30*a* and the second flap 30*b* are folded downward. This folding action exposes the cut-out portions of the first, second, third and fourth gusset tabs 32–35 as shown in FIG. 3. Other aspects of FIG. 3 are essentially as described above with respect to FIG. 2.

Figure 4:
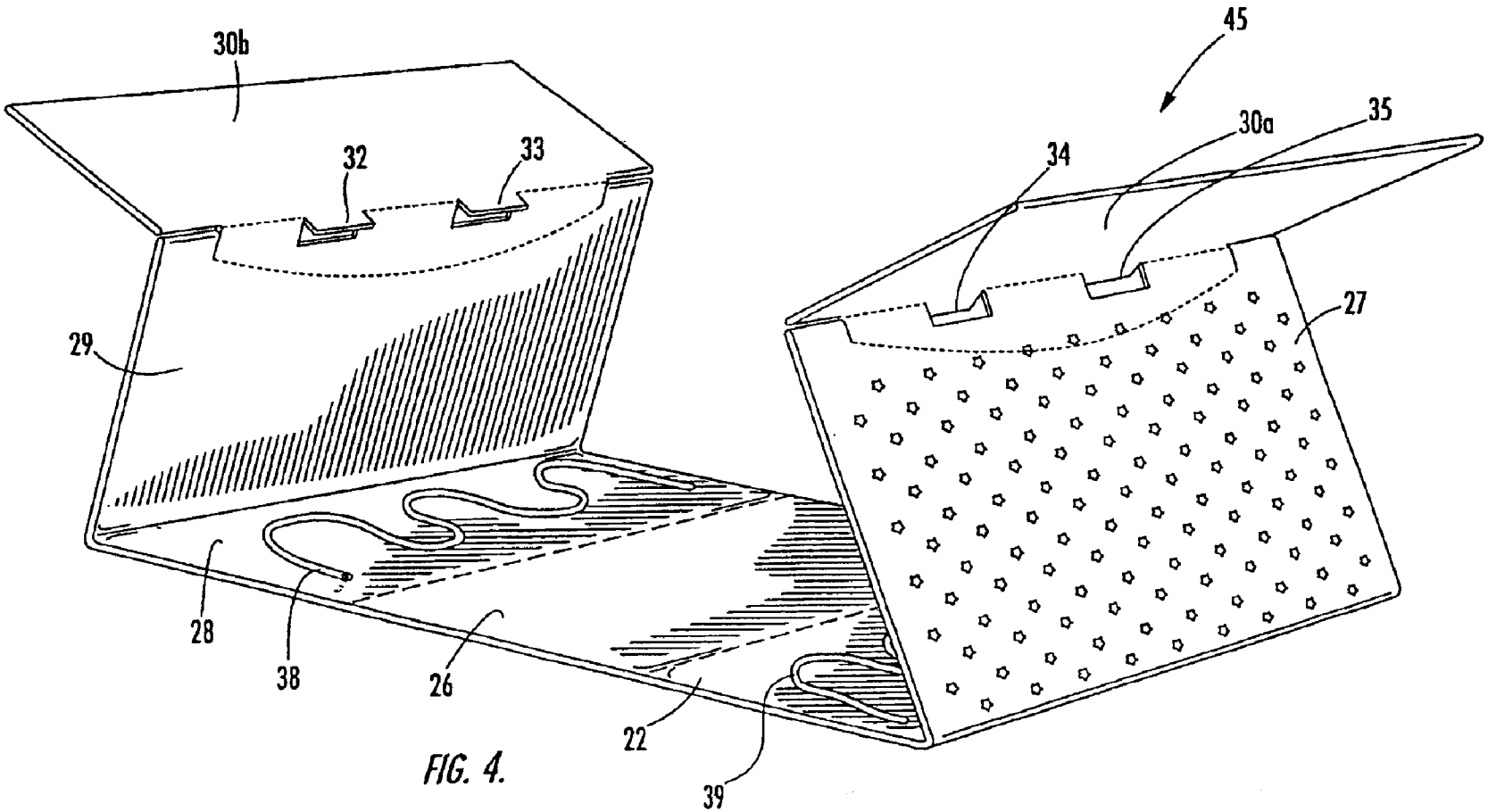

In FIG. 4, a next step in the construction of a dispenser 21 from the one-piece blank 45 is shown. In that FIG. 4, the first inner sidewall 27 and the second inner sidewall 29 are shown. The first and second inner sidewalls 27–29 are folded over, rotated, and pushed down upon the first outer sidewall 22 and second outer sidewall 28, respectively. A means of securing the inner and outer sidewalls is provided.

In FIG. 4, the means of securing the walls is shown as adhesive 38 and adhesive 39. The adhesive employed may be essentially any adhesive that may be applied to the one-piece blank 45 at relatively high speed in a manufacturing operation. Hot melt adhesives may be employed. However, the invention is not limited in any way to the application of adhesive as a means of securing the dispenser 21. Other applications could include stapling, punching, pinning, tacking, or otherwise fitting one panel to another. Furthermore, in other applications it may be possible to provide a self-adhesive strip or portion upon one or more of the inner or outer sidewalls which may be activated when the dispenser 21 is assembled by removing a self-adhesive strip (not shown) or by applying heat to the surface of one or more walls. There is no limit to the different means for securing the walls that could be employed, and the invention is not limited to only those described herein.

Figure 5:
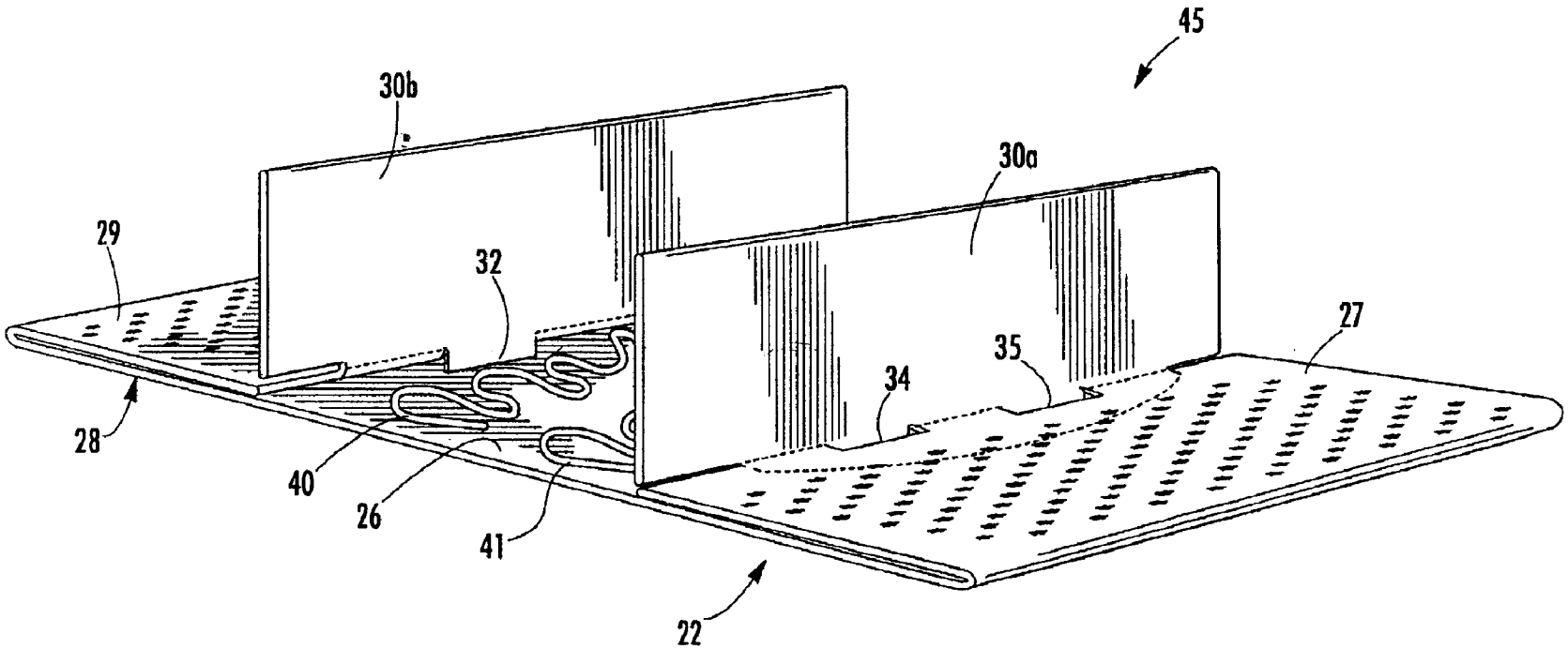

In FIG. 5, a next step in the construction of the dispenser 21 is shown in which the first inner sidewall 27 and second inner sidewall 29 have been secured to the first outer sidewall 22 and second outer sidewall 28. That is, in some applications of the invention, a second stage gluing step would be performed in which the first flap 30*a* and the second flap 30*b* are secured to the bottom panel 26 by a fastening or adhesive method. In the particular example shown in FIG. 5, adhesive 40 and adhesive 41 are employed. That is, when the walls of the one-piece blank 45 are erected, the first and second flaps 30*a–b* are adhered to the bottom panel 26.

Figure 6:
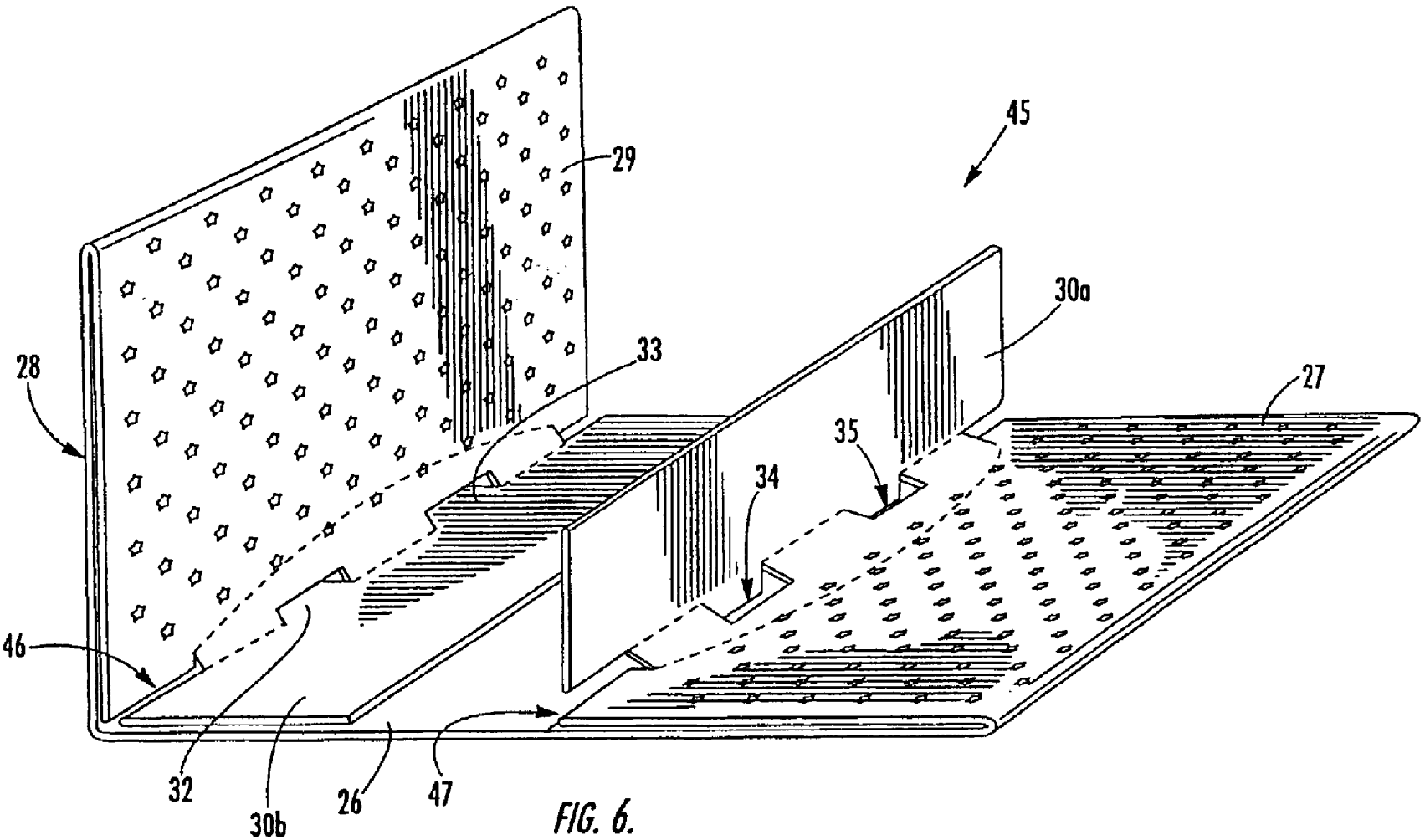

In FIG. 6, the second flap 30*b* has been secured to the bottom panel 26, which effectively removes space that may otherwise exist between second flap 30*b* and bottom panel 26. In the particular example shown in FIG. 6, a decorative motif has been applied to the second inner sidewall 29. In some cases, the decorative motif could be embossed, or preprinted upon a one-piece blank 45. In other applications, a screen printing or high-speed painting process could be employed. In yet other applications it would be possible to laminate a relatively thin preprinted decorative print upon the one-piece blank 45. In FIG. 6, the first gusset tab 32 and the second gusset tab 33 facilitate the entry of a portion of the second flap 30*b* into the notches formed by the first and second gusset tabs 32–33. In some applications of the invention, only one gusset tab would be used on each side of the one-piece blank 45. In other applications of the invention, it might not be necessary to use gusset tabs at all. However, it has proved to be advantageous to provide at least one gusset tab near the junction of a flap with one or more of the upright walls, along the first edge 46 and second edge 47 of the bottom panel, as shown in FIG. 6.

Figure 7:
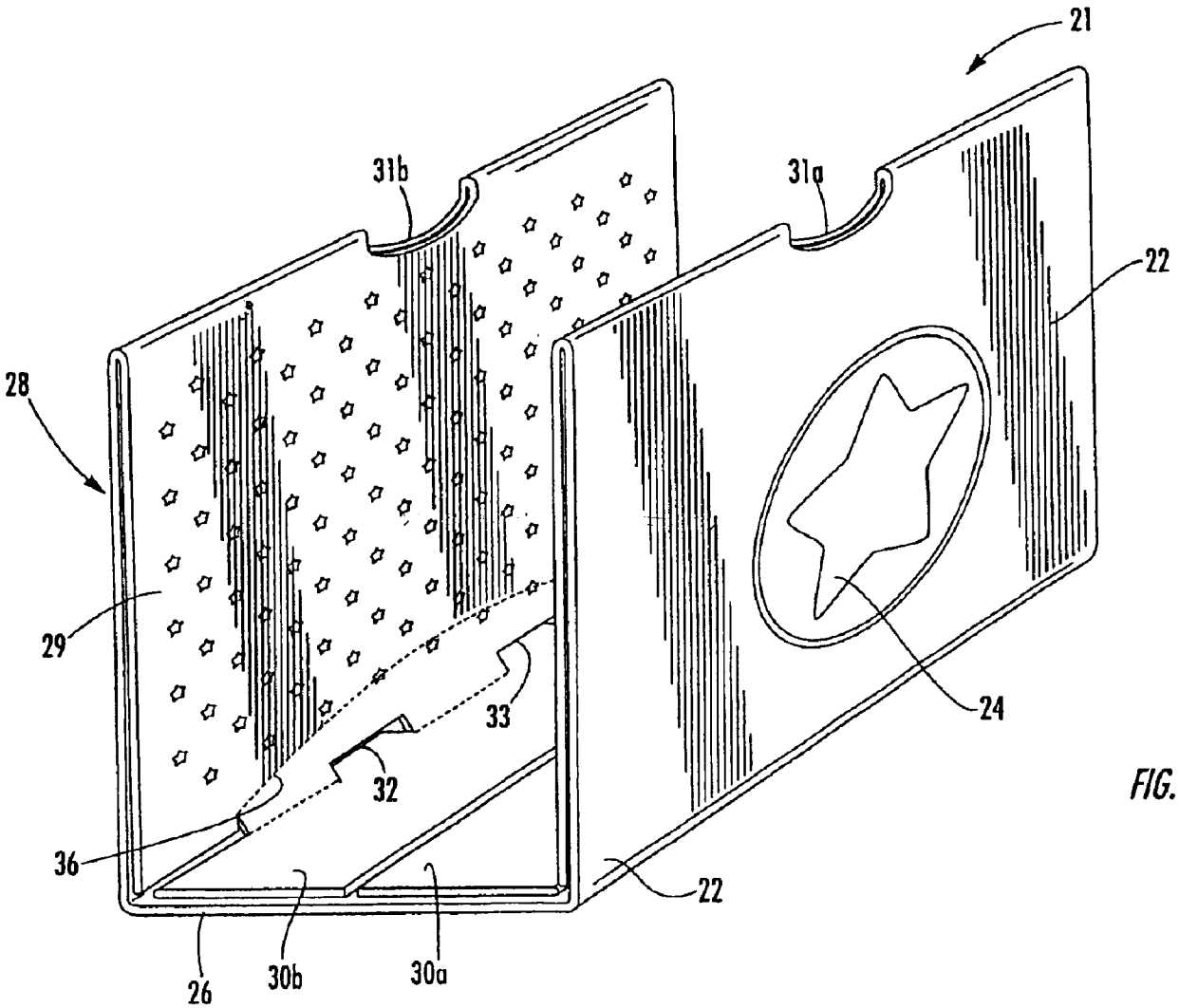

In FIG. 7, the embodiment shown in FIG. 6 is shown in a next step in which the first flap 30*a* has been adhered to the bottom panel 26. Furthermore, first and second finger access notches 31*a* and 31*b* are shown on the upper margin of the sidewalls, extending (i.e. cut through) both the outer and inner sidewalls. The first and second finger access notches 31*a–b* provide a convenient gripping location for a person to extract a stacked sheet 23 from the dispenser 21.

Figure 8:
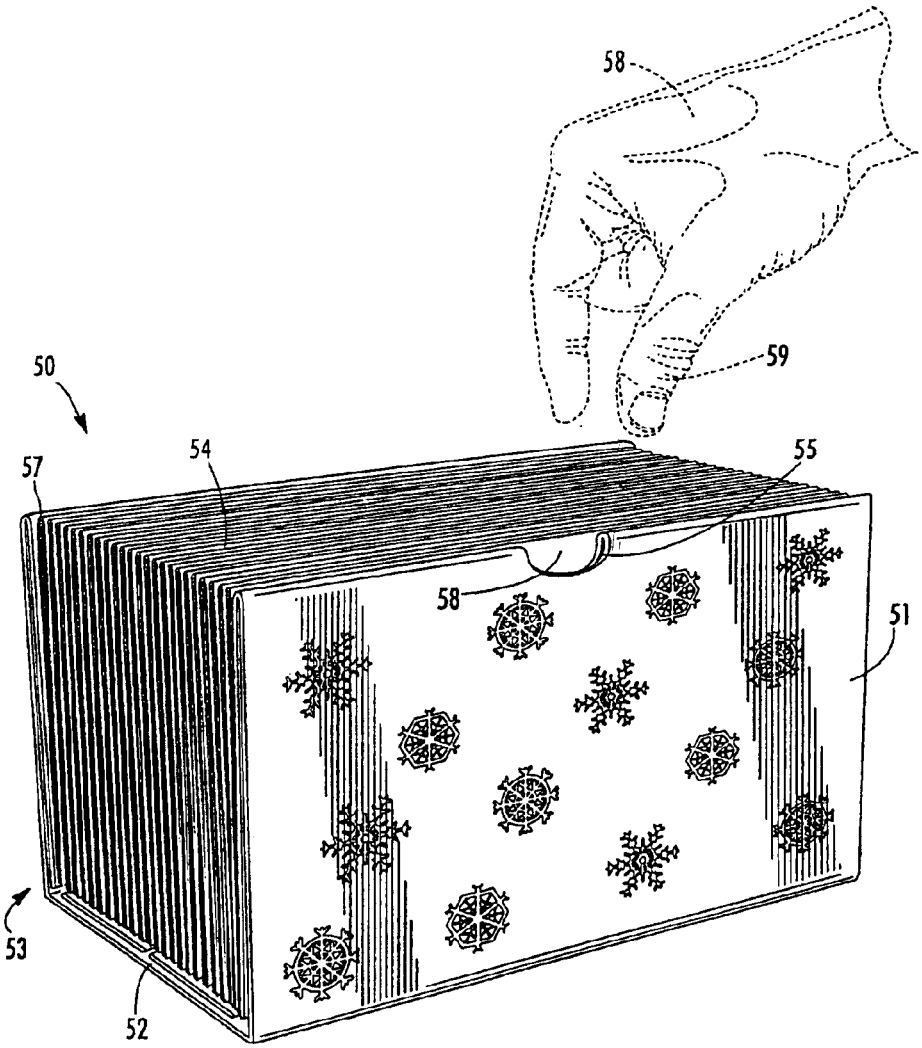
FIG. 8 illustrates a perspective view of an alternate configuration of the product comprising a carton and napkin stack in which the napkins are stacked vertically for convenient dispensing.

In FIG. 8, an alternate embodiment of the invention is shown in which a sheet dispenser 50 is provided with a first outer sidewall 51 and a second outer sidewall 53. The bottom panel 52 is shown, similar to that shown in previous embodiments. However, in the embodiment shown in FIG. 8 vertically stacked sheets 54 are provided, in which the sheets are folded and stacked in a vertical arrangement. A finger access notch 55 is shown, and the hand 58 having thumb 59 is able to effectively and conveniently grasp sheet 58 easily by inserting the thumb 59 into the open space formed by the finger access notch 55. Furthermore, the embodiment shown in FIG. 8 is particularly well adapted for a stacking arrangement in which the crease 57 (or fold) of the sheet is provided upwards, similar to that shown in FIG. 8. Although the invention is not limited to any particular folding or stacking arrangement, the arrangement shown in FIG. 8 is believed to function effectively.

In one embodiment of the invention, the carton may assume a tensioned position in which sheet material or napkins may be positioned between the first and second sidewalls and held in place, in part, by pressure applied from the first or second sidewall. That is, a second stage gluing application may provide the sidewalls in a slightly canted position in which they lean slightly towards each other and are capable of applying a slight restraining force to stacked sheet materials.

In at least one application of the invention, gusset tabs may be employed in connection with adhesive to secure the bottom flaps to a bottom panel, providing sidewalls which are slightly canted inward, and are capable of providing a tensioning force when filled with sheet material, such as napkins. This tensioning force can serve to grip the napkins firmly, for transport and display.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A carton adapted for storing and displaying stacked sheet material, the carton comprising a one-piece blank adapted to be folded in a manner resulting in a carton having (a) a bottom panel with a first edge and a second edge, (b) a first side wall and a second side wall, the bottom panel being joined to the first side wall along the first edge, the bottom panel being joined to the second side wall along the second edge, the first side wall comprising a first outer side wall and a first inner side wall, the first inner side wall being folded over and placed upon the first outer side wall such that a surface of the first outer side wall lies adjacent to and is in contact with an opposing surface of the first inner side wall, the first outer side wall being secured to the first inner side wall between the opposing surfaces;

(c) a first flap extending from the first inner side wall over at least a portion of the bottom panel, the first flap being secured to the bottom panel; and (d) a first arch located on the first inner side wall, the first arch comprising a perforation line.

2. The carton of claim 1 in which a second flap extends from the second side wall over at least a portion of the bottom panel, the second flap being secured to the bottom panel.

3. The carton of claim 2, wherein the second side wall comprises a second outer side wall and a second inner side wall, the second outer side wall being secured to the second inner side wall.

4. The carton of claim 3, further comprising a second arch located on the second inner side wall, the second arch comprising a perforation line.

5. The carton of claim 1 in which the first flap is secured to the bottom panel by an adhesive.

6. The carton of claim 1 in which at least one tab is provided near the junction of the first flap with the first inner side wall.

7. The carton of claim 1 in which the carton selectively comprises:

(i) a relaxed position in which at least one of the first and second side walls are canted towards each other, and (ii) a tensioned position in which the carton is adapted to be used for retaining sheet material positioned between the first and second side walls, wherein the sheet material is held in place in part by pressure applied from the first or second side wall.

8. The carton of claim 1, wherein the first flap is separated from the first inner side wall by a fold line, the first arch being spaced from the fold line, and wherein the first inner side wall is not secured to the first outer side wall in between the first arch and the fold line.

9. The carton of claim 1, wherein the one-piece blank comprises a paper blank.

10. A carton adapted for storing and displaying stacked sheet material, the carton comprising a one-piece blank adapted to be folded in a manner resulting in a carton having (a) a bottom panel with a first edge and a second edge, (b) a first side wall and a second side wall, the bottom panel being joined to the first side wall along the first edge, and the bottom panel being joined to the second side wall along the second edge, the first side wall comprising a first outer side wall and a first inner side wall, the second side wall comprising a second outer side wall and a second inner side wall; and (c) a first flap and a second flap extending from the first inner side wall and second inner side wall respectively, the first and second flaps extending from each respective side wall and over the bottom panel, the first and second flaps being affixed to the bottom panel, wherein the first and second side walls are erected such that the first inner side wall is folded over and placed upon the first outer side wall so that a surface of the first outer side wall lies adjacent to and is in contact with an opposing surface of the first inner side wall and such that the second inner side wall is also folded over and placed upon the second outer side wall so that a surface of the second outer side wall lies adjacent to and is in contact with an opposing surface of the second inner side wall, the first inner side wall being secured to the first outer side wall between the opposing surfaces and the second inner side wall being secured to the second outer side wall between the opposing surfaces.

11. The carton of claim 10 in which at least a first tab on the first wall and a second tab on the second wall are provided.

12. The carton of claim 11 in which the carton selectively comprises:

(i) a relaxed position in which at least one of the first and second side walls are canted towards each other, and (ii) a tensioned position in which the carton is adapted to be used for retaining sheet material is positioned between the first and second side walls, said sheet material being held in place in part by pressure from the first or second side wall upon the sheet material.

13. The carton of claim 12 in which the sheet material is a folded paper product.

14. The carton of claim 13 in which the folded paper product is a napkin.

15. The carton of claim 14 in which a decorative motif is applied to at least one side wall.

16. The carton of claim 14 in which access notches are provided in both the first and second side walls.

17. The carton of claim 10 in which adhesive is employed to affix the first and second flaps to the bottom panel.

18. The carton of claim 10 in which the first outer side wall is secured to the first inner side wall, and the second outer side wall is secured to the second inner side wall.

19. The carton of claim 18 in which the securing of said side walls is provided by adhesive.

20. The carton of claim 10, further comprising a first arch comprising a perforation line located on the first inner side wall and a second arch also comprising a perforation line located on the second inner side wall.

21. The carton of claim 20, wherein the first flap is separated from the first inner side wall by a first fold line, the first arch being spaced from the first fold line, and wherein the first inner side wall is not secured to the first outer side wall in between the first arch and the first fold line, and wherein the second flap is separated from the second inner side wall by a second fold line, the second arch being spaced from the second fold line, and wherein the second inner side wall is not secured to the second outer side wall in between the second arch and the second fold line.

22. A sheet material dispenser, comprising:

(a) a bottom panel having a first edge and a second edge, (b) a first side wall and a second side wall, the bottom panel being joined to the first side wall at the first edge and the second side wall at the second edge, the first side wall comprising a first outer side wall and a first inner side wall, the second side wall comprising a second outer side wall and a second inner side wall;

(c) a first flap and a second flap extending from the first inner side wall and second inner side wall respectively, the first and second flaps extending from each respective side wall and over the bottom panel, the first and second flaps being affixed to the bottom panel, wherein the first and second side walls are erected such that the first inner side wall is folded over and placed upon the first outer side wall so that a surface of the first outer side wall lies adjacent to and is in contact with an opposing surface of the first inner side wall and such that the second inner side wall is also folded over and placed upon the second outer side wall so that a surface of the second outer side wall lies adjacent to and is in contact with an opposing surface of the second inner side wall, the first inner side wall being secured to the first outer side wall between the opposing surfaces and the second inner side wall being secured to the second outer side wall between the opposing surfaces; and (d) first and second tabs positioned along the first and second edges of the bottom panel, respectively, the tabs being adapted to assist in maintaining erect the first and second side walls, thereby facilitating containment of stacked sheet material for transport or display.

23. The dispenser of claim 22, in which the dispenser is adapted to be used for retaining sheet material comprising napkins.

24. A system for transporting and displaying sheet material in a three-sided carton, the system comprising:

(a) a bottom panel having a first edge and a second edge, (b) a first side and a second side, the bottom panel being joined to the first side at the first edge and the second side at the second edge, the first side comprising a first outer side wall and a first inner side wall, the second side comprising a second outer side wall and a second inner side wall, the first and second sides being held generally erect;

(c) the system being adapted to retain sheet material stacked upon the bottom panel, said sheet material being positioned between the first side and the second side, the sheet material comprising a plurality of napkins; and (d) a removable outer protective wrap configured to encase and surround the carton.

25. The system of claim 24 further comprising:

first and second tabs positioned along the first and second edges of the bottom panel, respectively, the tabs being adapted to assist in maintaining erect the first and second sides, thereby facilitating containment of stacked sheet material for transport or display.

26. The system of claim 25 further comprising a means for maintaining the first and second sides in tensioned relation.

27. The system of claim 26 in which a first flap extends from the first side and is secured to the bottom panel.

28. The system of claim 27 in which a second flap extends from the second side and is secured to the bottom panel.

29. The system of claim 27 in which the first flap is secured to the bottom panel by an adhesive.

30. The system of claim 24 in which the carton is a one-piece carton.

31. The system of claim 24 in which the carton selectively comprises:

(i) a relaxed position in which at least one of the first and second sides are canted towards each other, and (ii) a tensioned position in which the carton is adapted to be used for retaining sheet material positioned between the first and second sides, said sheet material being held in place in part by pressure from the first or second side upon the sheet material.

* * * * *